United States Patent [19]

Tai et al.

[11] Patent Number: 4,842,970

[45] Date of Patent: Jun. 27, 1989

[54] ELECTROPHOTOGRAPHIC PLATE CONTAINING A NAPHTHALOCYANINE COMPOUND

[75] Inventors: Seiji Tai; Shigeru Hayashida; Nobuyuki Hayashi, all of Hitachi, Japan

[73] Assignee: Hitachi Chemical Co., Ltd., Tokyo, Japan

[21] Appl. No.: 184,027

[22] Filed: Apr. 20, 1988

[30] Foreign Application Priority Data

Apr. 22, 1987 [JP] Japan ..... 62-99043

[51] Int. Cl.[4] ..... G03G 54/024; G03G 5/06

[52] U.S. Cl. ..... 430/58; 430/59; 430/78; 540/122; 540/128; 540/140

[58] Field of Search ..... 430/58, 59, 78; 540/139, 140, 122, 128

[56] References Cited

U.S. PATENT DOCUMENTS

| | | | |
|---|---|---|---|
| 4,492,750 | 1/1985 | Law et al. | 430/526 X |
| 4,587,188 | 5/1986 | Kato et al. | 430/58 |
| 4,664,997 | 5/1987 | Suzuki et al. | 430/58 |
| 4,725,525 | 2/1988 | Kenney et al. | 430/338 X |
| 4,749,637 | 6/1988 | Hayashida et al. | 430/59 X |

FOREIGN PATENT DOCUMENTS

| | | | |
|---|---|---|---|
| 2145835A | 4/1985 | United Kingdom | 430/58 |

*Primary Examiner*—Roland E. Martin
*Assistant Examiner*—Jeffrey A. Linderman
*Attorney, Agent, or Firm*—Antonelli, Terry & Wands

[57] ABSTRACT

There is disclosed an electrophotographic plate comprising an electroconductive supporting substrate and a photoconductive layer formed thereon, wherein the photoconductive layer contains an organic photoconductive material as a charge generation material, said organic photoconductive material being a naphthalocyanine compound represented by the formula (I)

or the general formula (II)

wherein M denotes one member selected from the group consisting of Cu, Zn, Mg, OTi, OV, ClAl ClGa, ClIn, $Cl_2Si$, $Cl_2Ge$, and $Cl_2Sn$.

9 Claims, 3 Drawing Sheets

ELECTROPHOTOGRAPHIC PLATE CONTAINING A NAPHTHALOCYANINE COMPOUND

BACKGROUND OF THE INVENTION

1. FIELD OF THE INVENTION

The present invention relates to an electrophotographic photosensitive member, particularly an electrophotographic photosensitive plate having high sensitivity to rays of long wavelengths of about 800 nm that correspond to the oscillation frequency region of diode lasers.

2. STATEMENT OF THE RELATED ART

There is a conventional type of electrophotographic plate which comprises a selenium (Se) film about 50 μm thick formed by vacuum deposition on an electroconductive substrate such as an aluminum substrate. However, this Se plate has disadvantages such as the spectral sensitivity thereof limited to wavelengths of up to about 500 nm. Another conventional type of photosensitive member comprises an Se layer about 50 μm thick formed on a conductive substrate and further a selenium-tellurium (Se-Te) alloy layer several μm thick formed on the Se layer. While the spectral sensitivity of this photosensitive member extends to a longer wavelength as the Te content of the Se-Te alloy is increased, this increase in the Te content raises the serious problem of impairing the ability to retain the surface electric charge, making it practically impossible to use the photosensitive member.

On the other hand, there is a so-called complex double layer type of photosensitive member which is produced by applying chlorocyanine blue or a squarium acid derivative on an aluminum substrate to form a charge generation layer about 1 μm thick and then applying a material of high insulation resistance such as polyvinylcarbazole or a pyrazoline derivative-polycarbonate resin mixture on the charge generation layer to form a charge transport layer from 10 to 20 μm thick. But, this type of photosensitive member does not have sensitivity to rays of longer wavelengths than 700 nm.

Moreover, there is known a complex double layer type of photosensitive member corrected in the above noted drawback, that is, photosensitive members having sensitivity to rays of about 800-nm wavelengths that correspond to the oscillation frequencies of diode lasers. Most of these photosensitive members are provided with sensitivities to longer wavelengths by the vacuum deposition of a metal phthalocyanine having a group III or IV metal of the periodic table as a central metal to form an about 1-μm thin film, and dipping it in a shifting agent solution or contacting with a shifting agent vapor to shift the absorption band originally of about 700 nm to around 800 nm.

This thin film is coated with a 10- to 20-μm thick charge transport layer of a material of high insulation resistance such as polyvinylcarbazole or a mixture of a pyrazoline or hydrazone derivative with a polycarbonate or polyester resin, thereby making up a complex double layer type of photosensitive member.

However, this type of photosensitive member involves a significant problem. That is, the thin film, serving as a charge generation layer, formed of a metal phthalocyanine having a group III or IV metal as a central atom, has essentially no absorption at about 800 nm that corresponds to the oscillation frequency region of diode lasers. Hence, the photosensitive member comprising said thin film as a charge generation layer does not have sensitivity or has low sensitivity to rays of about 800-nm wavelengths, unless the film is treated with a shifting agent (see U.S. Pat. No. 4,426,434).

In recent years, a number of attempts have been made to apply diode lasers as light sources to laser beam printers and the like, wherein lasers other than diode lasers have been used as light sources and electrophotographic plates have been used. Since the wavelengths of rays from the light sources are around 800 nm in these attempts, there is strong demand for an electrophotographic plate having high sensitivity to rays of long wavelengths of about 800 nm.

OBJECT AND SUMMARY OF THE INVENTION

Accordingly, the primary object of the invention is to provide an electrophotographic plate having high sensitivity to rays of long wavelengths of about 800 nm.

The invention involves an electrophotographic plate comprising an electroconductive supporting substrate and a photoconductive layer formed thereon, wherein the photoconductive layer contains an organic photoconductive material which is a naphthalocyanine compound represented by the formula (I):

(I)

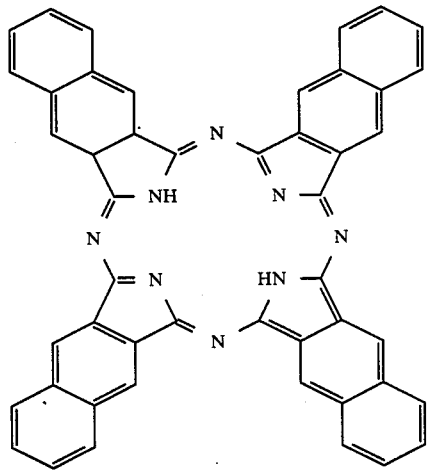

or the general formula (II):

(II)

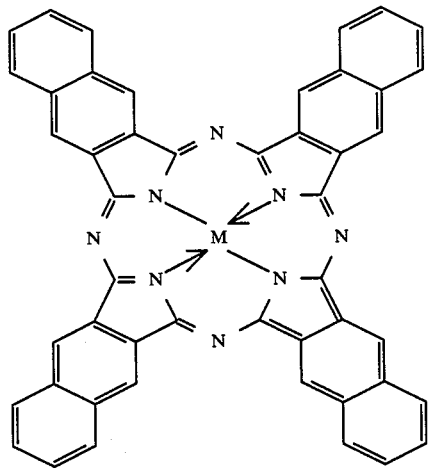

wherein M denotes a member selected from the group consisting of Cu, Zn, Mg, OTi, OV, ClAl, ClGa, ClIn, $Cl_2Si$, $Cl_2Ge$, and $Cl_2Sn$.

Figure 3:
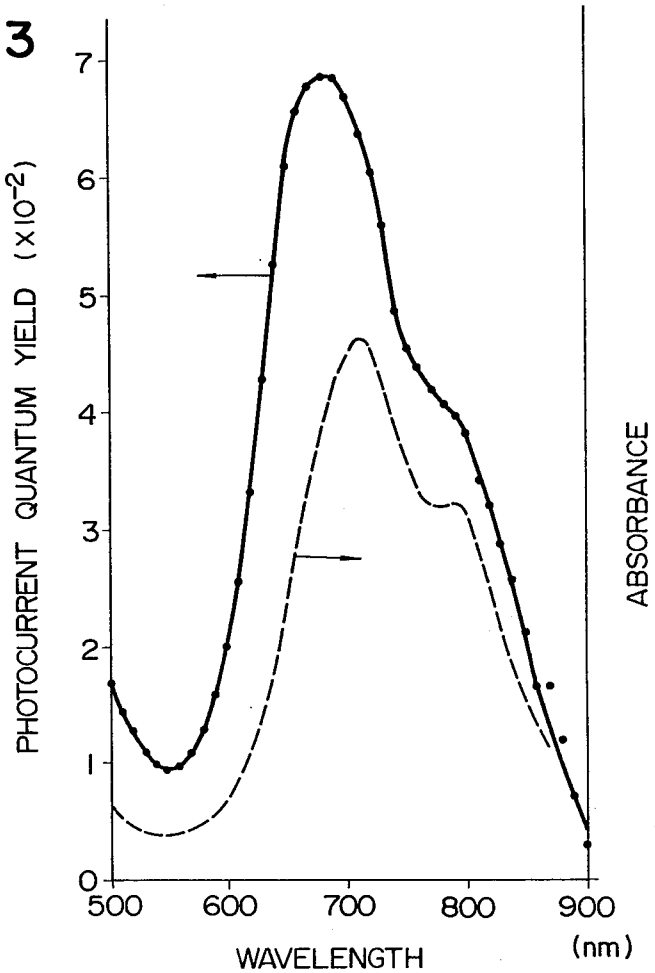

The solid line of FIG. 3 is the action spectrum (plot of quantum yield vs. light wavelength) of photocurrent through a copper naphthalocyanine (in formula (II), M is Cu) film formed by vapor deposition. The broken line of FIG. 3 is an absorption spectrum of a similar copper naphthalocyanine film.

Figure 4:
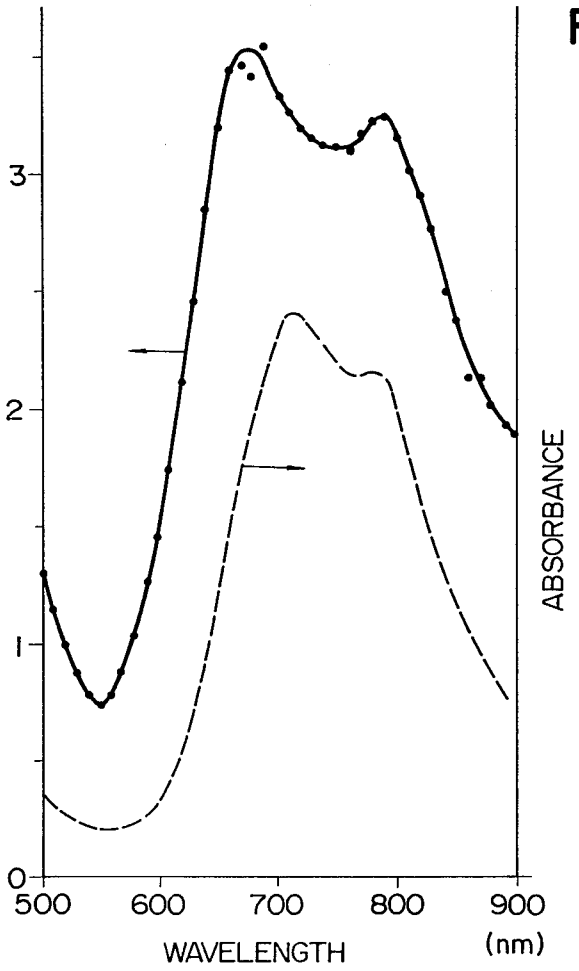

The solid line of FIG. 4 is the action spectrum of photocurrent through a vapor-deposited zinc naphthalocyanine (in formula II, M is Zn) film. The broken line of FIG. 4 is an absorption spectrum of a similar zinc naphthalocyanine film.

Figure 5:
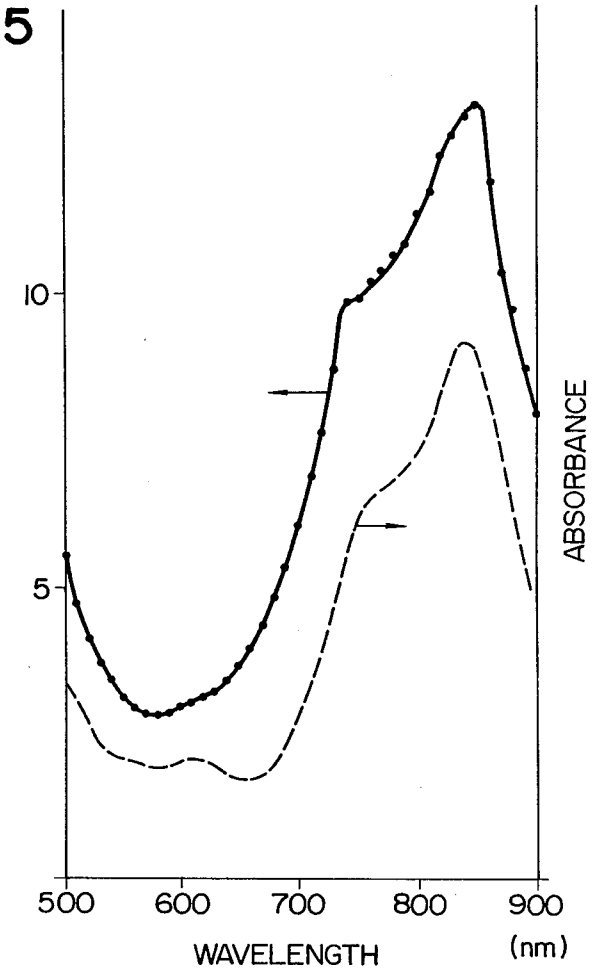

The solid line of FIG. 5 is the action spectrum of photocurrent flow through a vapor-deposited vanadyl naphthalocyanine (in formula (II), M is OV) film. The broken line of FIG. 5 is an absorption spectrum of a similar vanadyl naphthalocyanine film.

Figure 6:
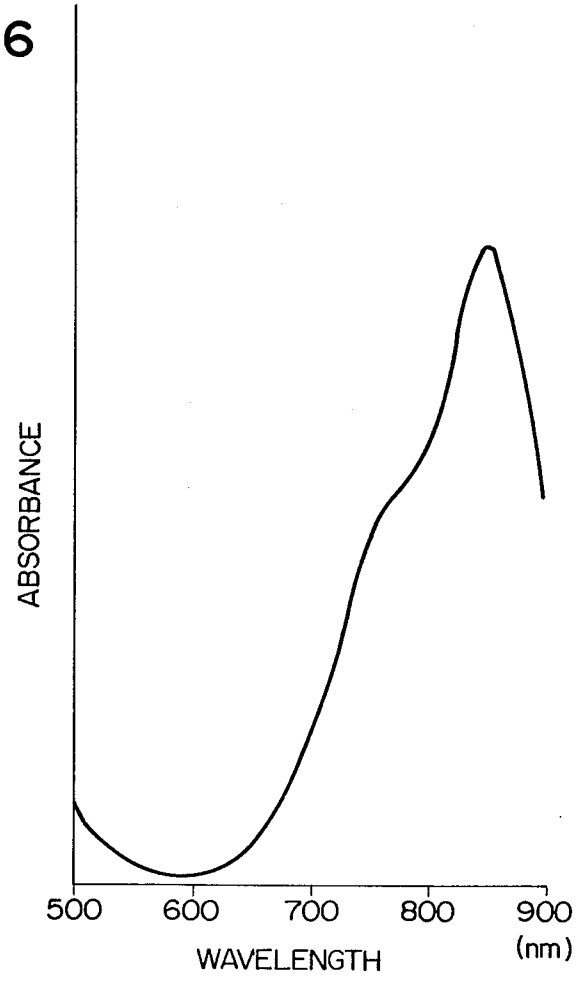

FIG. 6 shows an absorption spectrum of a vapor-deposited chloroindium naphthalocyanine (in formula (II), M is ClIn) film.

Figure 7:
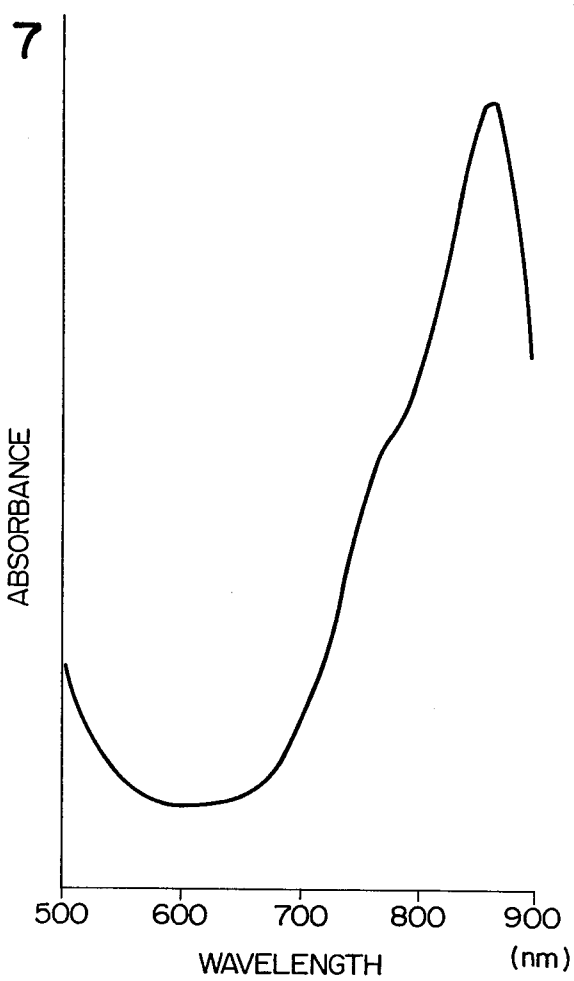

FIG. 7 shows an absorption spectrum of a vapor-deposited chloroaluminum naphthalocyanine (in formula (II), M is ClAl) film.

Meaning of symbols:

1—NESA film, 2—Glass plate, 3—Photoconductive layer, 4—Al film

DETAILED DESCRIPTION OF PREFERRED EMBODIMENTS

The naphthalocyanine compound of formula (I) used in the present inventive electrophotographic plate can be synthesized, for instance, by heating 2,3-dicyanonaphthalene in a sodium amyloxide-amyl alcohol mixture in the presence of a catalytic amount of ammonium molybdate under reflux for about 5 hours, and hydrolyzing the resulting sodium naphthalocyanine.

The naphthalocyanine compound of formula (II) can be synthesized in the following manner according to the known method described in Zhurnal Obshchei Khimii, Vol. 39, p. 2554. That is, the naphthalocyanine compound of formula (II) wherein M is a metal, metal oxide, or metal halide can be obtained by reacting 2,3-dicyanonaphthalene with the corresponding metal or metal salt at about 240° C. for about 2.5 hours in the presence of a catalytic amount of ammonium molybdate or by reacting 1,3-diiminobenzo[f]isoindoline, which is derived from 2,3-dicyanonaphthalene, with the corresponding metal or metal salt at about 220° C. for about 2.5 hours.

The above metal or metal salt to react is exemplified by CuCl, $CuCl_2$, Zn, Mg, $TiCl_4$, $VCl_3$, $AlCl_3$, $GaCl_3$, $InCl_3$, $SiCl_4$, GeCl, and $SnCl_4$. These reactions can be carried out with or without using a high boiling solvent such as quinoline, tetralin, 1-chloronaphthalene, 1-bromonaphthalene, or urea.

Examples of preferable naphthalocyanine compounds of the formula (I) or (II) are copper naphthalocyanine, zinc naphthalocyanine, oxytitanium naphthalocyanine, vanadyl naphthalocyanine, chloroaluminum naphthalocyanine, chlorogallium naphthalocyanine, chloroindium naphthalocyanine, metal-free naphthalocyanine and the like.

More preferable naphthalocyanine compounds are copper naphthalocyanine, zinc naphthalocyanine, vanadyl naphthalocyanine, chloroindium naphthalocyanine, chloroaluminum naphthalocyanine, metal-free naphthalocyanine and the like.

When irradiated with light, the naphthalocyanine compound of formula (I) or (II) generates electric charge.

The present inventive electrophotographic plate is provided with a photoconductive layer on an electroconductive support.

In the invention, the electroconductive supporting substrate is formed of a conductor such as; a paper or plastic film given conductivity by suitable treatment; plastic film overlaid with an aluminum foil or other metal foil; aluminum plate; or aluminum drum.

In the invention, the photoconductive layer is a film containing an organic photoconductive material, such as a coat of organic photoconductive material, a coat containing an organic photoconductive material and a binder, or a composite coat consisting of a charge generation layer and a charge transport layer.

For the above organic photoconductive material, a naphthalocyanine compound of formula (I) or (II) is used as an essential component and one or more known organic photoconductive materials may be used jointly therewith. It is preferable to use a charge transport material jointly with the naphthalocyanine compound of formula (I) or (II) or therewith along with a charge generation organic pigment. When the photoconductive layer is of the complex type, the charge generation layer contains said naphthalocyanine compound or a charge generation organic pigment in addition thereto while the charge transport layer contains a charge transport material.

Suitable charge generation organic pigments include those known to generate electric charge, such as pigments of an azoxybenzene goup, disazo group, trisazo group, benzimidazole group, polycyclic quinone group, indigoid group, quinacridone group, perylene group, methine group, and metal-free and metal-containing phthalocyanine groups having various crystal structures, e.g. $\alpha$-, $\beta$-, $\gamma$-, $\delta$-, $\epsilon$-, and $\chi$-forms. The use of these pigments as a charge generation material is disclosed, for example, in British Pat. Nos. 1,370,197; 1,337,222; 1,337,224; and 1,402,967; U.S. Pat. Nos. 3,887,366; 3,838,084; 3,824,099; and 4,028,102; Canadian Pat. No. 1,007,095; and German Pat. Offen. No. 2,260,540.

As disclosed in U.S. Pat. No. 4,619,879 and European Patent Application Laid-Open No. 92,255, metal-free phthalocyanine pigments of $\gamma$—, $\gamma'$-, $\eta$-, and $\eta'$- forms can also be used. Besides these pigments, any organic pigment may be used that produces charge carriers on light irradiation.

Suitable charge transport materials include; macromolecular compounds, e.g. poly-N-vinylcarbazole, halogenated poly-N-vinylcarbazole, polyvinylpyrene, polyvinylindoloquinoxaline, polyvinylbenzothiophene, polyvinylanthracene, polyvinylacridine, and polyvinylpyrazoline; and low molecular compounds, e.g. fluorenone, fluorene, 2,7-dinitro-9-fluorenone, 4H-indeno(1,2,6)-thiophene-4-one, 3,7-dinitrodibenzophenone-5-oxide, 1-bromopyrene, 2-phenylpyrene, carbazole, N-ethylcarbazole, 3-phenylcarbazole, 3-(N-methyl-N-phenyl- hydrazone)methyl-9-ethylcarbazole, 2-phenylindole, 2-phenylnaphthalene, oxadiazole, 2,5-bis(4-diethyl- aminophenyl)-1,3,4-oxadiazole, 1-phenyl-3-(4-diethyl- aminostyryl)-5-(4-diethylaminostyryl)-5-(4-diethylaminophenyl)pyrazoline, 1-phenyl-3-(p-diethylaminophenyl)pyrazoline, p-(dimethylamino)stilbene, 2-(4-dipropyl- aminophenyl)-4-(4-dimethylaminophenyl)-5-(2-chloro- phenyl)-1,3-oxazole, 2-(4-dimethylaminophenyl)-4-(4- dimethylaminophenyl)-5-(2-fluorophenyl)-1,3-oxazole, 2-(4-diethylaminophenyl)-4-(4-dimethylaminophenyl)5-(2-fluorophenyl)-1,3-oxazole, 2-(4-dipropylamino- phenyl)-4-(4-dimethylaminophenyl)-5-(2-fluorophenyl)1,3-oxazole, imidazole, chrysene, tetraphene, acridine, triphenylamine, and derivatives of these compounds.

When a charge transport material is used in mixture with the naphthalocyanine compound or therewith along with a charge generation organic pigment, the mixing ratio of the former to the latter is desired to be from 10/1 to 2/1 by weight. When the charge transport material in this case is a macromolecular compound, a binder may or may not be added. In this case as well as in the case where the charge transport material is a low molecular compound, the amount of binder to use is desirably up to 500% by weight based on the total amount of these compounds (the naphthalocyanine compound, charge generation organic pigment, and charge transport material). When a low molecular charge transport material is is used, a binder is added desirably in an amount of at least 30% by weight. When no charge transport material is used, a binder may also be added in a similar amount. Binders can be used jointly with additives, as occasion demands, which include plasticizers, flow improvers, and pinhole inhibitors.

When forming a complex photoconductive layer consisting of a charge generation layer and a charge transport layer, the charge generation layer contains the naphthalocyanine compound or this and a charge generation organic pigment and preferably may contain further a binder in an amount of up to 500% by weight based on the organic pigments and moreover the above-mentioned additive in an amount of up to 5% by weight based on the amount of the naphthalocyanine compound or on the total amount of this compound and the organic pigment. The charge transport layer contains the above-mentioned charge transport material and preferably may contain further a binder in an amount of up to 500% by weight based on the charge transport material. When the charge transport material is a low molecular compound, a binder is desirably added in an amount of at least 50% by weight based on the low molecular compound. Moreover, the charge transport layer may contain the above-mentioned additive in an amount of up to 5% by weight based on the charge transport material.

Binders usable in all the cases stated above include silicone resin, polyamide resin, polyurethane resin, polyester resin, epoxy resin, polyketone resin, polycarbonate resin, polyacrylic resin, polystyrene resin, styrene-butadiene copolymer, polymethyl methacrylate resin, polyvinyl chloride, ethylene-vinyl acetate copolymer, vinyl chloride-vinyl acetate copolymer, polyacrylamide resin, polyvinylcarbazole, polyvinylpyrazoline, polyvinylpyrene, etc. Thermosetting resins and photosetting resins can also be used that can be cross-linked by heating and/or light irradiation.

In any case, there is no particular restriction on the binder resin to use: any resin may be used that is an insulator and can form a coating film under ordinary conditions or can be cured with heat and/or light to form a coating film.

Suitable plasticizers include halogenated paraffin, dimethylnaphthalene, dibutyl phthalate, etc. Suitable flow improvers include Modaflow (tradename, available from Monsanto Co.), Acronal (tradename, available from BASF, A.G.), etc. Suitable pinhole inhibitors include benzoin, dimethyl phthalate, etc. These additives are suitably chosen and may be used in suitable amounts.

The electrophotographic plate of the invention comprises a photoconductive layer formed on an electroconductive layer, as stated before. The photoconductive layer is desired to have a thickness of 5 to 50 μm. When using a complex photoconductive layer consisting of charge generation and charge transport layers, the charge generation layer is formed to a thickness of desirably from 0.001 to 10 μm, preferably from 0.2 to 5 μm. A thinner charge generation layer than 0.001 μm is difficult to form uniformly. When the thickness of the charge generation layer exceeds 10 μm, electrophotographic characteristics of the resulting photosensitive member tend to deteriorate. The thickness of the charge transport layer is desirably from 5 to 50 μm, preferably from 8 to 20 μm. When this thickness is less than 5 μm, the initial potential will be undesirably low. When thickness exceeds 50 μm, the sensitivity tends to be lowered.

For the formation of a photoconductive layer on a conductive layer, a suitable method is the vapor deposition of a photoconductive material on the conductive layer. Another method comprises dissolving or dispersing uniformly an organic photoconductive material and, if necessary, other ingredients in a solvent, and applying the solution or dispersion on the conductive layer, followed by drying. The solvent is selected from; ketones, e.g. acetone and methyl ethyl ketone; ethers, e.g. tetrahydrofuran; aromatic hydrocarbons, e.g. toluene and xylene; halogenated hydrocarbons, e.g. methylene chloride and carbon tetrachloride; and alcohols, e.g. methanol, ethanol, and propanol. The coating can be carried out by spin coating, dip coating, or other methods. The charge generation layer and the charge transport layer can also be formed in the same manner. In this case, either of these layers may be the upper layer. It is also allowed to interpose a charge generation layer between two charge transport layers.

In the vacuum deposition of the present inventive naphthalocyanine compound, it is desirable to heat the compound under a high vacuum of $10^{-5}$ to $10^{-6}$ mm Hg. The application of the present naphthalocyanine compound by spin coating is desirably carried out as follows: The compound is dispersed in a halogenated solvent such as chloroform or in a nonpolar solvent such as toluene to prepare a coating liquid and this liquid is applied by spin coating at a revolution of 3000 to 7000 rpm. The dip coating is desirably carried out as follows: The present naphthalocyanine compound is dispersed in a polar solvent such as methanol or dimethylformamide by using a ball mill or a supersonic wave to prepare a coating liquid and the conductive substrate is dipped in this coating liquid.

The electrophotographic plate of the invention may be provided additionally with a thin bond layer or barrier layer directly over the conductive layer and also may have a protective layer at the top. A protective coating may be formed according to the coating and drying procedure of forming the photoconductive layer.

The present invention is illustrated with reference to the following Preparation Examples, Test Examples, and Examples. However, none of these examples restrict the scope of the invention.

PREPARATION EXAMPLE 1

Preparation of 2,3-dicyanonaphthalene

100 Gram (0.67 mole) of sodium iodide was added to 400 ml of an anhydrous N,N-dimethylformamide solution containing 42.2 g (0.1 mole) of $\alpha,\alpha,\alpha',\alpha'$-tetrabromo-o-xylene and 13.5 g (0.173 mole) of fumalonitrile with vigorous stirring. This reaction mixture was stirred at 75° C. for about 7 hours under a nitrogen atmosphere to complete reaction. Then the mixture was poured into about 2 Kg of ice-water, and sodium hydrogensulfite was gradually added to the resulting red-brown solution until it turned pale yellow. Further, sodium hydrogensulfite was added in slight excess. After stirring for a while, the mixture was left standing overnight at room temperature. The formed pale yellow precipitate was filtered with suction, washed thoroughly with water, and naturally dried. This dry solid, upon recrystallization from ethanol-chloroform, gave 13 g (73% yield) of 2,3-dicyanonaphthalene (colorless crystals). Melting point 256.5°–257.5° C. (literature value 256° C.).

PREPARATION EXAMPLE 2

Preparation of copper naphthalocyanine

25 Milliliter of a quinoline solution containing 4.45 g (25 m moles) of 2,3-dicyanonaphthalene, 1.36 g (8 m moles) of cupric chloride dihydrate ($CuCl_2 \cdot 2H_2O$), and about 100 mg of ammonium molybdate was heated with vigorous stirring at about 240° C. for 2.5 hours. This reaction mixture, allowed to cool, was filtered with suction. The black solid separated was washed thoroughly with acetone, methanol, water, methanol, and acetone in that order. The resulting solid was placed in a soxhlet extractor, washed by extraction with a 1:1 acetone-methanol mixture for about 200 hours, and dried, giving 2.3 g (47% yield) of copper naphthalocyanine (black solid). An absorption spectrum of a film formed from this copper naphthalocyanine by vapor deposition is shown by a broken line in FIG. 3.

Elementary analysis:

| | Elementary analysis: | | |
|---|---|---|---|
| | C | H | N |
| Calcd. (%) | 74.26 | 3.12 | 14.43 |
| Found (%) | 73.99 | 3.02 | 14.44 |

PREPARATION EXAMPLE 3

Preparation of zinc naphthalocyanine

Empirical formula $CuC_{48}N_8H_{24}$

25 Milliliter of a quinoline solution containing 4.45 g (25 m moles) of 2,3-dicyanonaphthalene, 52 mg (8 m moles) of zinc dust, and about 100 mg of ammonium molybdate was heated with vigorous stirring at about 240° C. for 2.5 hours. This reaction mixture, allowed to cool, was treated similarly to Preparation Example 2, giving 3.34 g (69% yield) of zinc naphthalocyanine (black-brown glossy solid). An absorption spectrum of a film formed from this zinc naphthalocyanine by vapor deposition is shown by a broken line in FIG. 4.

Elementary analysis:

| | Elementary analysis: | | |
|---|---|---|---|
| | C | H | N |
| Calcd. (%) | 74.09 | 3.11 | 14.40 |
| Found (%) | 74.45 | 3.14 | 14.70 |

PREPARATION EXAMPLE 4

Preparation of vanadyl naphthalocyanine

25 Milliliter of a quinoline solution containing 4.45 g (25 m moles) of 2,3-dicyanonaphthalene, 1.6 g (10 m moles) of vanadium trichloride ($VCl_3$), and about 100 mg of ammonium molybdate was heated with vigorous stirring at about 240° C. for 2.5 hours. This reaction mixture, allowed to cool, was treated similarly to Preparation Example 2, giving 4.7 g (96% yield) of vanadyl naphthalocyanine (dark green solid). An absorption spectrum of a film formed from this vanadyl naphthalocyanine by vapor deposition is shown by a broken line in FIG. 5.

Elementary analysis:

| | Elementary analysis: | | |
|---|---|---|---|
| | C | H | N |
| Calcd. (%) | 73.94 | 3.10 | 14.37 |
| Found (%) | 73.26 | 3.06 | 14.00 |

PREPARATION EXAMPLE 5

Preparation of chloroindium naphthalocyanine

Empirical formula: $VC_{48}N_8H_{24}O$

25 Milliliter of a quinoline solution containing 4.45 g (25 m moles) of 2,3-dicyanonaphthalene, 2.35 g (8 m moles) of indium trichloride tetrahydrate, and about 100 mg of ammonium molybdate was heated with vigorous stirring at about 240° C. for 2.5 hours. This reaction mixture, allowed to cool, was treated similarly to Preparation Example 2, giving 2.6 g (48% yield) of chloroindium naphthalocyanine (black-green solid). An absorption spectrum of a film formed from this chloroindium naphthalocyanine by vapor deposition is shown in FIG. 6.

Elementary analysis:

| | Elementary analysis: | | |
|---|---|---|---|
| | C | H | N |
| Calcd. (%) | 66.80 | 2.80 | 12.98 |
| Found (%) | 66.40 | 2.70 | 12.83 |

PREPARATION EXAMPLE 6

Preparation of chloroaluminum naphthalocyanine

Empirical formula: $InC_{48}N_8H_{24}Cl$

25 Milliliter of a quinoline solution containing 4.45 g (25 m moles) of 2,3-dicyanonaphthalene, 1.07 g (8 m moles) of aluminum chloride, and about 100 mg of ammonium molybdate was heated with vigorous stirring at about 240° C. for 2.5 hours. This reaction mixture, allowed to cool, was treated similarly to Preparation Example 2, giving 3.67 g (76% yield) of chloroaluminum naphthalocyanine (black-green solid). An absorption spectrum of a film formed from this chloroaluminum naphthalocyanine by vapor deposition is shown in FIG. 7.

Elementary analysis:

| | Elementary analysis: | | |
|---|---|---|---|
| | C | H | N |
| Calcd. (%) | 74.37 | 3.12 | 14.45 |
| Found (%) | 74.75 | 3.08 | 14.76 |

PREPARATION EXAMPLE 7

Preparation of metal-free naphthalocyanine

Empirical formula: $AlC_{48}N_8H_{24}Cl$ 4.45 Gram (25 m moles) of 2,3-dicyanonaphthalene, about 100 mg of ammonium molybdate, 10 g of sodium amyloxide, and 50 g of amyl alcohol were heated under reflux for 5 hours. This reaction mixture, allowed to cool, was filtered with suction. The separated sodium naphthalocyanine (black solid) was hydrolyzed by heating in aqueous methanol (90% methanol) under reflux for 5 hours. The resulting mixture was filtered with suction and the separated metal-free naphthalocyanine (black solid) was washed thoroughly with acetone, methanol, water, methanol, and acetone in that order. The resulting solid was placed in a Soxhlet extractor, washed by extraction with a 1:1 acetone-methanol mixture for about 200 hours, and dried, giving 2.0 g (45% yield) of metal-free naphthalocyanine (black solid).

TEST EXAMPLE 1

Figure 1:
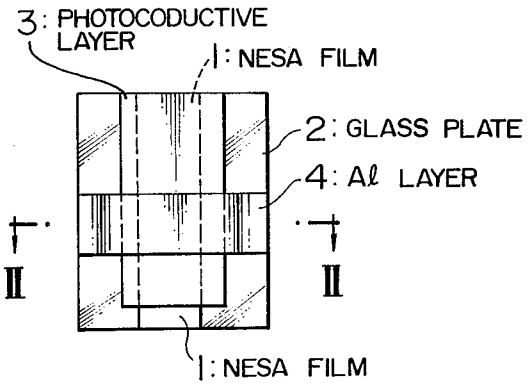
FIG. 1 is a plane view of a sandwich cell for photocurrent measurement.
Figure 2:
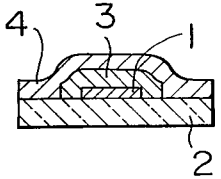
FIG. 2 is a cross-sectional view taken on line a—a' of FIG. 1.

A sandwich cell for photocurrent measurement was prepared in the following way. The structure of the cell is shown in FIGS. 1 and 2. FIG. 1 is a plane view of the cell and FIG. 2 is a cross-sectional view taken on line a—a' of FIG. 1.

A glass plate 2 supporting an NESA film 1 (about 1 cm wide) was fixed in place in a vacuum deposition chamber. Copper naphthalocyanine was placed in a vacuum-evaporation boat made of tungsten, and heated in the vacuum deposition chamber at temperatures of 550°-650° C. under a vacuum of $3\times10^{-6}$ Torr, thereby depositing a photoconductive layer 3 on the NESA film 1 to cover it with the photoconductive layer except that a portion of the NESA film and a portion of the glass plate were uncovered. Then, aluminum was vapor-deposited on the portions of the photoconductive layer and of the glass plate to form a 1-cm wide and about 300-Å thick Al layer 4 across the surface of the photoconductive layer.

Using a silver paste, lead wires were connected severally to the NESA film and the Al layer of the thus prepared sandwich cell, and photocurrents were measured in the following way: The cell was irradiated with a 300-W halogen lamp through a monochrometer (supplied by Ritsu Oyokagaku Co., Ltd.). The photocurrent produced by the irradiation was measured with a lock-in amp. (NF circuit supplied by Block Co.). Rays of wavelengths ranging from 500 to 900 nm were used at intervals of 10 nm for the irradiation. The photocurrent Ip produced at each wavelength was divided by the intensity Io of the irradiating light of that wavelength, thereby determining the photocurrent quantum yield $\eta$ ($\eta=Ip/Io$). FIG. 3 shows the action spectrum obtained by plotting each quantum yield vs. the wavelength. The copper naphthalocyanine film formed by vapor deposition was about 2500 Å thick.

TEST EXAMPLE 2

According to the procedure of Test Example 1, a sandwich cell comprising zinc naphthalocyanine was prepared and photocurrents were measured. The zinc naphthalocyanine film formed by vapor deposition was about 2500 Å thick. The action spectrum obtained is shown in FIG. 4.

TEST EXAMPLE 3

According to the procedure of Test Example 1, a sandwich cell comprising a vapor-deposited vanadyl naphthalocyanine film about 2500 Å thick was prepared and photocurrents were measured. The action spectrum obtained is shown in FIG. 5.

EXAMPLE 1

Copper naphthalocyanine, that is, a compound of formula (II) wherein M is Cu, synthesized in Preparation Example 2 was vacuum-deposited on an aluminum-metalized substrate by electric resistance heating under a vacuum of $3\times10^{-6}$ mm Hg to form a charge generation layer 3000 Å thick.

A solution of 5 g of 1-phenyl-3-(p-diethyl- aminostyryl)-5-(p-diethylaminophenyl)pyrazoline and 10 g of a polycarbonate resin in 85 g of a 1:1 methylene chloride-1,1,2-trichloroethane mixture was applied by dip coating on the charge generation layer formed on the substrate, and was dried at 120° C. for 30 minutes, thereby forming a charge transport layer 15 μm thick.

The thus prepared photosensitive member was given negative charge by a 5-KV corona discharge using an electrostatic charging test machine (supplied Kawaguchi Denki Co., Ltd.). Then, the photosensitive member was exposed to monochromatic light produced by filtering rays from a halogen lamp through a monochrometer (supplied by Ritsu Oyokogaku Co., Ltd.), where the decay of surface potential on light exposure was measured on this photosensitive member.

The result indicated that the half-decay exposure quantity (the product of time and light intensity to halve the initial surface potential) was 15 $mJ/m^2$ when this photosensitive member was exposed to monochromatic near-infrared light of 800 nm wavelength.

EXAMPLE 2

According to the procedure of Example 1, a charge generation layer was formed by vacuum deposition of zinc naphthalocyanine, that is, a compound of formula (II) wherein M is Zn, synthesized in Preparation Example 3.

A solution of 5 g of 1-phenyl-3-(p-diethylaminostyryl)-5-(p-diethylaminophenyl)pyrazoline and 10 g of a polycarbonate resin in 85 g of a 1:1 methylene chloride-1,1,2-trichloroethane mixture was applied by dip coating on the charge generation layer formed on the substrate, and was dried at 120° C. for 30 minutes, thereby forming a charge transport layer 15 μm thick.

On the thus prepared photosensitive member, measurement of the half-decay exposure quantity was made in the same manner as in Example 1 by using monochromatic near-infrared light of 800 nm wavelength. The found value was 20 $mJ/m^2$.

EXAMPLE 3

According to the procedure of Example 1, a charge generation layer was formed by vacuum deposition of vanadyl naphthalocyanine, that is, a compound of formula (II) wherein M is OV, synthesized in Preparation Example 4.

A solution of 5 g of 1-phenyl-3-(p-diethylamino-styryl)-5-(p-diethylaminophenyl)pyrazoline and 10 g of a polycarbonate resin in 85 g of a 1:1 methylene chloride-1,1,2-trichloroethane mixture was applied by dip coating on the charge generation layer formed on the substrate, and was dried at 120° C. for 30 minutes, thereby forming a charge transport layer 15 μm thick.

On the thus prepared photosensitive member, measurement of the half-decay exposure quantity was made in the same manner as in Example 1 by using monochromatic near-infrared light of 800 nm wavelength. The found value was 25 mJ/m$^2$. EXAMPLE 4

According to the procedure of Example 1, a charge generation layer was formed by vacuum deposition of chloroindium naphthalocyanine, that is, a compound of formula (II) wherein M is ClIn, synthesized in Preparation Example 5.

A solution of 5 g of 1-phenyl-3-(p-diethyl- aminostyryl)-5-(p-diethylaminophenyl)pyrazoline and 10 g of a polycarbonate resin in 85 g of a 1:1 methylene chloride-1,1,2-trichloroethane mixture was applied by dip coating on the charge generation layer formed on the substrate, and was dried at 120° C. for 30 minutes, thereby forming a charge transport layer 15 μm thick.

On the thus prepared photosensitive member, measurement of the half-decay exposure quantity was made in the same manner as in Example 1 by using monochromatic near-infrared light of 800 nm wavelength. The found value was 23 mJ/m$^2$.

EXAMPLE 5

According to the procedure of Example 1, a charge generation layer was formed by vacuum deposition of chloroaluminum naphthalocyanine, that is, a compound of formula (II) wherein M is ClAl, synthesized in Preparation Example 6.

A solution of 5 g of 1-phenyl-3-(p-diethyl- aminostyryl)-5-(p-diethylaminophenyl)pyrazoline and 10 g of a polycarbonate resin in 85 g of a 1:1 methylene chloride-1,1,2-trichloroethane mixture was applied by dip coating on the charge generation layer formed on the substrate, and was dried at 120° C. for 30 minutes, thereby forming a charge transport layer of 15 μm thick.

On the thus prepared photosensitive member, measurement of the half-decay exposure quantity was made in the same manner as in Example 1 by using monochromatic near-infrared light of 800 nm wavelength. The found value was 24 mJ/m$^2$.

COMPARATIVE EXAMPLE 1

Vacuum deposition of metal-free phthalocyanine on an aluminum-metalized substrate was carried out under a vacuum of $2\times10^{-5}$ mm Hg, and a photosensitive member similar to that of Example 1 was prepared. Under the same conditions the decay of surface potential on light exposure was measured on this photosensitive member. The result indicated that the half-decay exposure quantity was 3000 mJ/m$^2$ for monochromatic light of 800 nm wavelength. Thus, this photosensitive member was much inferior in sensitivity to those of Examples 1–5 wherein naphthalocyanine compounds of formula (1) or (II) were used.

In the next place, metal naphthalocyanines and metal-free naphthalocyanine prepared before were dispersed each in a binder, a charge generation layer was formed from the resulting dispersion, and a charge transport layer was formed on the charge generation layer by using the following materials. The thus prepared complex type photosensitive members (100 mm×70 mm) were evaluated for electrophotographic characteristics.

(1) Charge generation material

Naphthalocyanine compounds synthesized in Preparation Examples 2–7.

(2) Charge transport material

Hydrazone derivative: p-Dimethylamino-o-ethoxybenzaldehyde diphenylhydrazone (HYZ) having the following structure:

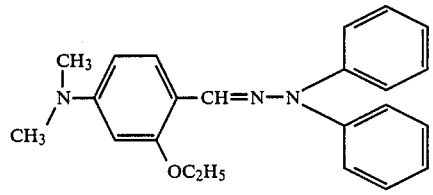

(3) Binder

Silicone varnish: KR-255 (supplied by Shinetsu Chemical Industry Co., Ltd.) or

Polycarbonate resin: IUPILON S-2000 (supplied by Mitsubishi Gas Chemical Co., Inc.)

EXAMPLES 6–11

(a) A liquid mixture of 2.5 g of a naphthalocyanine compound shown in Table 1, 5.0 g of the silicone varnish (solid content 50 wt. %), and 92.5 g of methyl ethyl ketone was ball-milled (using a 10-cm pot mill supplied by Nippon Kagakutogyo Co., Ltd.) for 8 hours. The pigment dispersion prepared was applied by an applicator on an aluminum plate (100 mm×70 mm conductor), and dried at 90° C. for 15 minutes to form a charge generation layer 1 μm thick.

(b) Then, a coating liquid for charge transport layers was prepared by intermixing uniformly 10 g of said hydrazone compound (HYZ) that is a charge transport material, 10 g of the binder S-2000, and 40 g of methylene chloride and 40 g of 1,1,2-trichloroethane, as solvents. Immediately thereafter, the coating liquid was applied on the charge generation layer so as to give a dry thickness of 15 μm, and was dried at 120° C. for 2 hours to form a charge transport layer. In this manner, electrophotographic plates were prepared by using different naphthalocyanine compounds.

COMPARATIVE EXAMPLE 2

An electrophotographic plates was prepared according to the procedure of Examples 6–11 but using bis(-trihexylsiloxy)silicon naphthalocyanine as a charge generation material.

COMPARATIVE EXAMPLE 3

An electrophotographic plates was prepared according to the procedure of Examples 6–11 but using α-form phthalocyanine (supplied by BASF A.G.) as a charge generation material.

Electrophotographic characteristics of the plates prepared in Examples 6–11 and Comparative Examples 2 and 3 were measured by using the above-mentioned electrostatic charging test machine (model SP-428, supplied by Kawaguchi Denki Co., Ltd.). Results of the measurement are shown in Table 1. In this table; initial potential $V_0$ is the potential given to the surface of the plates attached onto the rotable disk of SP-428, by a −5 KV corona discharge for 10 seconds while rotating the disk at 1000 rpm; dark decay $V_k$ is the potential decay ($V_k = V_{30}/V_0) \times 100$, $V_{30}$: potential after 30 sec.) in standing of the photosensitive member in the dark for 30 seconds after the corona discharge had been stopped; and half-decay exposure quantity $E_{50}$ is the energy of light (product of light intensity and time) incident thereafter on a unit area of the plates until the initial potential $V_0$ was halved by exposure to monochromatic light of 800 nm wavelength which was produced by filtering rays from a halogen lamp through a monochrometer (supplied by Ritsu Oyokogaku Co., Ltd.); and residual potential $V_R$ is the potential remaining on the plate after exposure to the monochromatic light for 60 seconds.

As are evident from the results shown in Table 1, all the electrophotographic plate prepared in Examples 6–11 exhibited higher $V_0$ values than 1000 V, being superior in electric chargeability and further exhibited low $E_{50}$ values of up to 25 mJ/m$^2$, slight dark decay, and no residual potential, thus being excellent in electrophotographic characteristics. In contrast, the plates of Comparative Examples 2 and 3 employing naphthalocyanine compound and phthalocyanine compound in the charge generation layers were much inferior in sensitivity.

TABLE 1

| | Charge generation material | $V_O$ (−V) | $V_k$ (%) | $E_{50}$ (mJ/m$^2$) | $V_R$ (−V) |
|---|---|---|---|---|---|
| Example | Preparation Example | | | | |
| 6 | 2 | 1100 | 78 | 18 | 20 |
| 7 | 3 | 1150 | 74 | 22 | 20 |
| 8 | 4 | 1050 | 76 | 25 | 20 |
| 9 | 5 | 1200 | 72 | 24 | 20 |
| 10 | 6 | 1100 | 70 | 25 | 10 |
| 11 | 7 | 1150 | 75 | 20 | 10 |
| Comparative Example | | | | | |
| 2 | | 950 | 72 | 300 | 280 |
| 3 | | 900 | 74 | 350 | 300 |

The present inventive electrophotographic plates show great absorption at around 800 nm and have high sensitivity to rays of these long wavelengths without being treated with any shifting agent, hence exhibiting excellent effects when used in particular in laser beam printers. In addition, the present inventive photosensitive members can also be applied favorably to facsimiles, printers provided with LED light sources, and moreover to other optical recording devices provided with diode laser light sources.

What is claimed is:

1. An electrophotographic plate comprising an electroconductive supporting substrate and a photoconductive layer formed thereon, wherein the photoconductive layer contains an organic photoconductive material as a charge generation material, said organic photoconductive material being a naphthalocyanine compound represented by the formula (I)

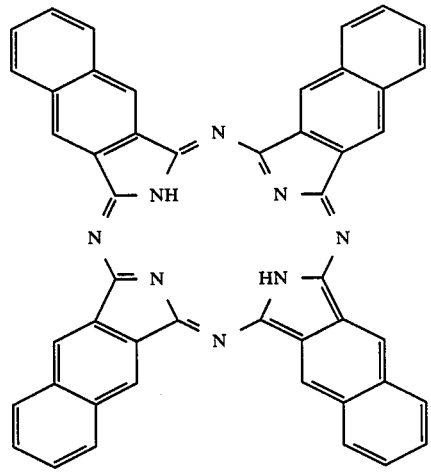

or the general formula (II)

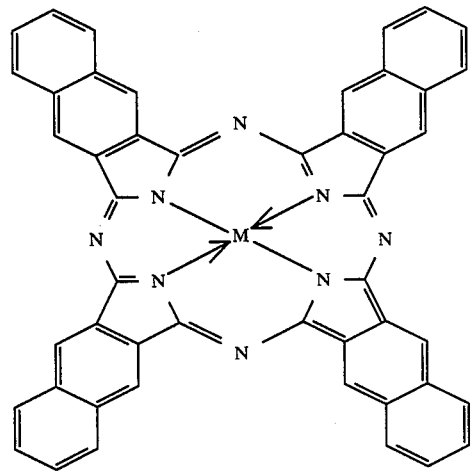

wherein M denotes one member selected from the group consisting of Cu, Zn, Mg, OTi, OV, ClAl, ClGa, ClIn, $Cl_2Si$, $Cl_2Ge$, and $Cl_2Sn$.

2. The electrophotographic plate of claim 1, wherein the photoconductive layer is a complex type comprising a charge generation layer containing the naphthalocyanine compound of the formula (I) or (II) and a charge transport layer.

3. The electrophotographic plate of claim 1, wherein the photoconductive layer comprises a charge generation material and a charge transport material.

4. The electrophotographic plate of claim 1, wherein the photoconductive layer comprises the naphthalocyanine compound of the formula (I) or (II) and a binder.

5. The electrophotographic plate of claim 2, wherein the charge generation layer contains the naphthalocyanine compound of the formula (I) or (II) and a binder, and the charge transport layer contains the charge transport material and a binder.

6. The electrophotographic plate of claim 2 or 5, wherein the charge generation layer is from 0.001 to 10 μm thick and the charge transport layer is from 5 to 10 μm thick.

7. The electrophotographic plate of claim 6, wherein the charge generation layer is from 0.2 to 5 μm thick and the charge transport layer is from 8 to 20 μm thick.

8. The electrophotographic plate of any of claims 1 to 7, wherein the naphthalocyanine compound is copper naphthalocyanine, zinc naphthalocyanine, oxytitanium naphthalocyanine, vanadyl naphthalocyanine, chloroaluminum naphthalocyanine, chlorogallium naphthalocyanine, chloroindium naphthalocyanine, or metal-free naphthalocyanine.

9. The electrophotographic plate of claim 8 wherein the naphthalocyanine compound is copper naphthalocyanine, zinc naphthalocyanine, vanadyl naphthalocyananine, chloroindium naphthalocyanine, chloroaluminum naphthalocyanine or metal-free naphthalocyanine.

* * * * *

Electrophotographic characteristics of the plates prepared in Examples 6–11 and Comparative Examples 2 and 3 were measured by using the above-mentioned electrostatic charging test machine (model SP-428, supplied by Kawaguchi Denki Co., Ltd.). Results of the measurement are shown in Table 1. In this table; initial potential $V_0$ is the potential given to the surface of the plates attached onto the rotable disk of SP-428, by a −5 KV corona discharge for 10 seconds while rotating the disk at 1000 rpm; dark decay $V_k$ is the potential decay $(V_k = V_{30}/V_0) \times 100$, $V_{30}$: potential after 30 sec.) in standing of the photosensitive member in the dark for 30 seconds after the corona discharge had been stopped; and half-decay exposure quantity $E_{50}$ is the energy of light (product of light intensity and time) incident thereafter on a unit area of the plates until the initial potential $V_0$ was halved by exposure to monochromatic light of 800 nm wavelength which was produced by filtering rays from a halogen lamp through a monochrometer (supplied by Ritsu Oyokogaku Co., Ltd.); and residual potential $V_R$ is the potential remaining on the plate after exposure to the monochromatic light for 60 seconds.

As are evident from the results shown in Table 1, all the electrophotographic plate prepared in Examples 6–11 exhibited higher $V_0$ values than 1000 V, being superior in electric chargeability and further exhibited low $E_{50}$ values of up to 25 mJ/m$^2$, slight dark decay, and no residual potential, thus being excellent in electrophotographic characteristics. In contrast, the plates of Comparative Examples 2 and 3 employing naphthalocyanine compound and phthalocyanine compound in the charge generation layers were much inferior in sensitivity.

TABLE 1

| | Charge generation material | $V_O$ (−V) | $V_k$ (%) | $E_{50}$ (mJ/m$^2$) | $V_R$ (−V) |
|---|---|---|---|---|---|
| Example | Preparation Example | | | | |
| 6 | 2 | 1100 | 78 | 18 | 20 |
| 7 | 3 | 1150 | 74 | 22 | 20 |
| 8 | 4 | 1050 | 76 | 25 | 20 |
| 9 | 5 | 1200 | 72 | 24 | 20 |
| 10 | 6 | 1100 | 70 | 25 | 10 |
| 11 | 7 | 1150 | 75 | 20 | 10 |
| Comparative Example | | | | | |
| 2 | | 950 | 72 | 300 | 280 |
| 3 | | 900 | 74 | 350 | 300 |

The present inventive electrophotographic plates show great absorption at around 800 nm and have high sensitivity to rays of these long wavelengths without being treated with any shifting agent, hence exhibiting excellent effects when used in particular in laser beam printers. In addition, the present inventive photosensitive members can also be applied favorably to facsimiles, printers provided with LED light sources, and moreover to other optical recording devices provided with diode laser light sources.

What is claimed is:

1. An electrophotographic plate comprising an electroconductive supporting substrate and a photoconductive layer formed thereon, wherein the photoconductive layer contains an organic photoconductive material as a charge generation material, said organic photoconductive material being a naphthalocyanine compound represented by the formula (I)

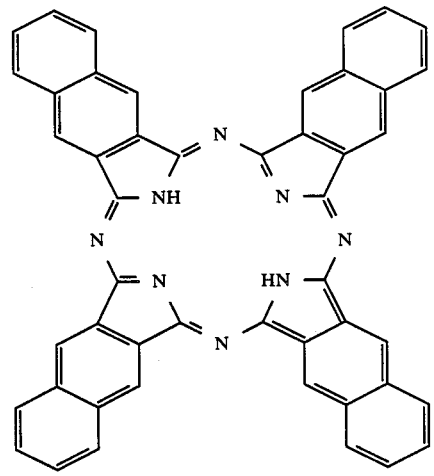

or the general formula (II)

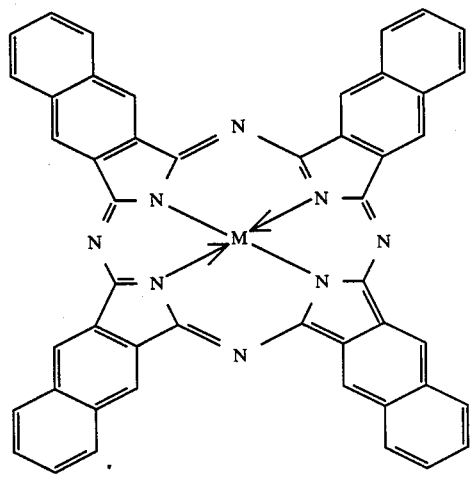

wherein M denotes one member selected from the group consisting of Cu, Zn, Mg, OTi, OV, ClAl, ClGa, ClIn, $Cl_2Si$, $Cl_2Ge$, and $Cl_2Sn$.

2. The electrophotographic plate of claim 1, wherein the photoconductive layer is a complex type comprising a charge generation layer containing the naphthalocyanine compound of the formula (I) or (II) and a charge transport layer.

3. The electrophotographic plate of claim 1, wherein the photoconductive layer comprises a charge generation material and a charge transport material.

4. The electrophotographic plate of claim 1, wherein the photoconductive layer comprises the naphthalocyanine compound of the formula (I) or (II) and a binder.

5. The electrophotographic plate of claim 2, wherein the charge generation layer contains the naphthalocyanine compound of the formula (I) or (II) and a binder, and the charge transport layer contains the charge transport material and a binder.

6. The electrophotographic plate of claim 2 or 5, wherein the charge generation layer is from 0.001 to 10 μm thick and the charge transport layer is from 5 to 10 μm thick.

7. The electrophotographic plate of claim 6, wherein the charge generation layer is from 0.2 to 5 μm thick and the charge transport layer is from 8 to 20 μm thick.

8. The electrophotographic plate of any of claims 1 to 7, wherein the naphthalocyanine compound is copper naphthalocyanine, zinc naphthalocyanine, oxytitanium naphthalocyanine, vanadyl naphthalocyanine, chloroaluminum naphthalocyanine, chlorogallium naphthalocyanine, chloroindium naphthalocyanine, or metal-free naphthalocyanine.

9. The electrophotographic plate of claim 8 wherein the naphthalocyanine compound is copper naphthalocyanine, zinc naphthalocyanine, vanadyl naphthalocyananine, chloroindium naphthalocyanine, chloroaluminum naphthalocyanine or metal-free naphthalocyanine.

* * * * *